US006158981A

United States Patent [19]

Raghavan et al.

[11] Patent Number: 6,158,981

[45] **Date of Patent: *Dec. 12, 2000**

[54] METHOD AND APPARATUS FOR ASEPTIC PRESSURE-PROCESSING OF PUMPABLE SUBSTANCES

[75] Inventors: Chidambaram Raghavan; Bruce Schuman, both of Kent; Curtis Anderson, Puyallup; Edmund Ting, Kent, all of Wash.

[73] Assignee: Flow International Corporation, Kent, Wash.

[ * ] Notice: This patent is subject to a terminal disclaimer.

[21] Appl. No.: 09/100,157

[22] Filed: Jun. 18, 1998

[51] Int. Cl.[7] ..... F04B 43/06

[52] U.S. Cl. ..... 417/395

[58] Field of Search ..... 417/395, 394, 417/567, 518, 466, 460; 99/453; 426/665

[56] References Cited

U.S. PATENT DOCUMENTS

| | | | |
|---|---|---|---|
| 2,644,401 | 7/1953 | Ragland | 103/45 |
| 3,094,074 | 6/1963 | Tuckey | 103/44 |
| 3,405,642 | 10/1968 | Freeman | 103/50 |
| 4,325,296 | 4/1982 | Ukai et al. | 99/468 |
| 4,439,113 | 3/1984 | Owen | 417/394 |
| 4,565,297 | 1/1986 | Korner et al. | 220/254 |
| 4,695,472 | 9/1987 | Dunn et al. | 426/237 |
| 4,707,952 | 11/1987 | Krasnoff | 51/410 |
| 4,723,387 | 2/1988 | Krasnoff | 51/410 |
| 4,789,313 | 12/1988 | Tower et al. | 417/388 |

(List continued on next page.)

FOREIGN PATENT DOCUMENTS

| | | | |
|---|---|---|---|
| 0687421A1 | 12/1995 | European Pat. Off. | A23L 1/015 |
| 0713654A1 | 5/1996 | European Pat. Off. | A23L 3/015 |
| 0772981A1 | 6/1997 | European Pat. Off. | A23L 3/015 |
| 1 336 044 | 7/1963 | France . | |
| 2 087 099 | 12/1971 | France | F04B 49/00 |
| 2 442 018A | 7/1980 | France | A23L 1/32 |
| 2-690854A1 | 11/1993 | France | B01J 3/00 |
| 2 740 301A1 | 4/1997 | France | A23L 1/025 |
| 4242311A | 8/1993 | Germany | A23L 3/015 |
| 4406028A1 | 8/1995 | Germany | A61L 2/02 |

(List continued on next page.)

OTHER PUBLICATIONS

American Bosch, "Hydro–Pneumatic Accumulators," AC 110–02–2, AMBAC Industries, Springfield, MA, Sep. 1976.

Flow Technology Co., "Development of a High–Pressure Abrasive Jet Cutting Tool for Enhancement of Fracturing in Unconventional Natural Gas Formations (Phase 1)," Part A. Technical Proposal, *Flow Technology Proposal No. 8265*, Oct. 1981.

Flow Industries, Inc., "Experimental and Theoretical Investigation of Metals Cutting by Abrasive Jets—Phase II Program," *Flow Research Proposal No. 8251*, Apr. 1982.

(List continued on next page.)

*Primary Examiner*—Teresa Walberg
*Assistant Examiner*—Vinod D. Patel
*Attorney, Agent, or Firm*—Seed IP Law Group PLLC

[57] ABSTRACT

Improved methods and apparatus for pressure processing of pumpable substances are shown and described. In one embodiment, the apparatus includes an inlet valve, an outlet valve, and a pressure vessel. The inlet valve has an inlet port, and is coupled to a source of a pumpable substance and to the pressure vessel. The outlet valve has an outlet port and is coupled to the pressure vessel. When the inlet valve is opened and the outlet valve is closed, a volume of pumpable substance may flow into the pressure vessel. The inlet valve is then closed and the outlet valve remains closed, and the pumpable substance within the pressure vessel may be pressurized to a selected pressure for a selected period of time. The outlet valve is then opened, allowing the pumpable substance to be discharged. In an alternate embodiment, the apparatus may include at least one aseptic valve assembly having elements which cooperate to apply cleansing solution to one or more surfaces, the surfaces having the potential of being contaminated. The cleansing solution may be applied to the surface by cleansing chambers or by nozzles.

48 Claims, 9 Drawing Sheets

U.S. PATENT DOCUMENTS

| | | | |
|---|---|---|---|
| 5,037,276 | 8/1991 | Tremoulet, Jr. | 417/567 |
| 5,037,277 | 8/1991 | Tan | 417/567 |
| 5,048,404 | 9/1991 | Bushnell et al. | 99/451 |
| 5,075,124 | 12/1991 | Horie et al. | 426/577 |
| 5,184,434 | 2/1993 | Hollinger et al. | 51/317 |
| 5,213,029 | 5/1993 | Yutaka | 99/474 |
| 5,226,799 | 7/1993 | Raghavan et al. | 417/53 |
| 5,228,394 | 7/1993 | Kanda et al. | 99/453 |
| 5,232,726 | 8/1993 | Clark et al. | 426/519 |
| 5,235,905 | 8/1993 | Bushnell et al. | 99/451 |
| 5,288,462 | 2/1994 | Carter et al. | 422/39 |
| 5,316,745 | 5/1994 | Ting et al. | 422/295 |
| 5,370,043 | 12/1994 | Träff et al. | 99/467 |
| 5,439,703 | 8/1995 | Kanda et al. | 426/665 |
| 5,458,901 | 10/1995 | Engler et al. | 426/521 |
| 5,470,547 | 11/1995 | Lhenry | 422/295 |
| 5,579,682 | 12/1996 | Bergman et al. | 99/473 |
| 5,585,076 | 12/1996 | Buteau et al. | 422/295 |
| 5,588,357 | 12/1996 | Tomikawa et al. | 99/451 |
| 5,593,714 | 1/1997 | Hirsch | 426/268 |
| 5,622,678 | 4/1997 | Hiltawsky et al. | 422/295 |
| 5,658,610 | 8/1997 | Bergman et al. | 426/665 |
| 5,891,505 | 4/1999 | Schuman et al. | 426/665 |
| 5,993,172 | 11/1999 | Schuman et al. | 417/394 |
| 5,996,478 | 12/1999 | Schuman et al. | 99/453 |

FOREIGN PATENT DOCUMENTS

| | | | |
|---|---|---|---|
| 53-124176A | 10/1978 | Japan | A61L 1/00 |
| 58-150078 | 6/1983 | Japan | F04B 9/12 |
| 62-066862A | 3/1987 | Japan | A01L 2/02 |
| 62-069969A | 3/1987 | Japan | A23C 3/00 |
| 62-122546A | 6/1987 | Japan | A21C 11/20 |
| 63-82667A | 4/1988 | Japan | A61L 2/02 |
| 1-196251A | 8/1989 | Japan | A22C 25/00 |
| 1-300841A | 12/1989 | Japan | A22C 25/00 |
| 2-089598A | 3/1990 | Japan | B30B 11/00 |
| 2-089877A | 3/1990 | Japan | A23L 3/01 |
| 2-182157A | 7/1990 | Japan | A23L 1/01 |
| 2-245146A | 9/1990 | Japan | A23L 1/025 |
| 3-080066A | 4/1991 | Japan | A23L 1/01 |
| 3-147772A | 6/1991 | Japan | A23L 1/20 |
| 3-292863A | 12/1991 | Japan | A23J 3/26 |
| 4-063569A | 2/1992 | Japan | A23L 1/20 |
| 4-108369A | 4/1992 | Japan | A23L 3/01 |
| 4-299967A | 10/1992 | Japan | A23L 3/015 |
| 4-356177A | 12/1992 | Japan | A23L 3/015 |
| 5-023118A | 2/1993 | Japan | A23L 1/01 |
| 5-056752A | 3/1993 | Japan | A23J 3/26 |
| 5-161483A | 6/1993 | Japan | A23L 3/015 |
| 5-227926A | 9/1993 | Japan | A23L 3/015 |
| 5-252920A | 10/1993 | Japan | A23L 3/015 |
| 5-284950A | 11/1993 | Japan | A23L 3/015 |
| 6-014726A | 1/1994 | Japan | A23L 1/01 |
| 6-125753A | 5/1994 | Japan | A23L 3/015 |
| 7-147929A | 6/1995 | Japan | A23L 1/275 |
| 7-180770A | 7/1995 | Japan | F16J 10/00 |
| 8-108459A | 4/1996 | Japan | B29C 47/12 |
| 8-168515A | 7/1996 | Japan | A61L 2/06 |
| 8-267296A | 10/1996 | Japan | B30B 5/00 |
| 2184791A | 7/1987 | United Kingdom | F04B 43/10 |
| WO 94/21145 | 9/1994 | WIPO | A23L 3/015 |
| WO 95/21690 | 8/1995 | WIPO | B01J 3/04 |
| WO 96/11588 | 4/1996 | WIPO | A23L 1/212 |
| WO 97/21361 | 6/1997 | WIPO | A23L 3/015 |
| WO 97/38591 | 10/1997 | WIPO | A23L 1/212 |
| WO 97/43914 | 11/1997 | WIPO | A23L 3/015 |

OTHER PUBLICATIONS

Flow Industries, Inc., "Development of an Improved Oil Well Drilling Method Using Fluid–Abrasive Jets," *Technical Proposal*, Apr. 1983.

Hashish, M., "Comparative Evaluation of Abrasive–Fluidjet Machining Systems," presented at *The Winter Annual Meeting of the American Society of Mechanical Engineers*, the Production Engineering Division, ASME, San Francisco, CA, Dec. 10–15, 1989, pp. 13–21.

Quest Integrated, Inc., "High Velocity Jet Cutting with Liquefied Gases," Project Summary, Jun. 14, 1991.

Hori et al., "The Development of High Pressure Processor for Food Industries," *High Pressure and Biotechnology*, 224:449–507, 1992.

Rovere, Pierpaolo, "The Third Dimension of Food Technology—Next to Time and Temperature, a New and Revolutionary Operative Parameter: High Pressure," *Technologie Alimentari Sistemi Per Produce*, No. 4, 1995.

Hori, K. et al., "The Development of High Pressure Processor for Food Industries," Mitsubishi Heavy Industries, Ltd., pp. 1–8.

Greer Olaer Products, "Floating Piston Accumulators," *Bulletin No. 1000*, Greer Hydraulics, Inc., Los Angeles, CA.

METHOD AND APPARATUS FOR ASEPTIC PRESSURE-PROCESSING OF PUMPABLE SUBSTANCES

TECHNICAL FIELD

This invention relates to improved methods and apparatus for pressure processing of pumpable substances, for example, food substances and the like.

BACKGROUND OF THE INVENTION

Many objectives may be achieved by exposing a pumpable substance to high pressure. For example, high pressure processing may be used to render a desired physical change in a substance by pressurizing the substance to a selected pressure for a selected period of time. High pressure processing may be used to chemically or physically modify chemical or biological substances, including food products. High pressure may be used to improve the quality of existing products, and to generate new products.

In brief, pressure-processing may be achieved by loading a substance into a pressure vessel, where it is pressurized to a selected pressure for a selected amount of time, commonly referred to as the "dwell time," to achieve the desired physical change in the substance. The vessel is then depressurized, and the contents unloaded. The pressure vessel is then reloaded with a volume of unprocessed substance, and the process is repeated.

Although current systems produce desirable results, issues of product contamination can arise. Contamination is an important issue in certain applications, particularly those involving pressure-processing of food substances. Contamination may potentially come from the outside environment, or may potentially result from exposure of the pressure-processed product to the unprocessed substance.

SUMMARY OF THE INVENTION

This invention relates to improved methods and apparatus for aseptic pressure-processing of pumpable substances. In one embodiment, the apparatus includes an inlet valve, an outlet valve, and a pressure vessel. A pumpable substance is loaded into the pressure vessel through the inlet valve, where it is pressurized, and the pressure-processed product is discharged through the outlet valve.

The inlet valve of the aforesaid embodiment has an inlet port, and is fluidly coupled to a source of a pumpable substance and to the pressure vessel. The pressure vessel has a first opening in communication with the inlet valve, and a second opening in communication with the outlet valve. The inlet valve may be moveable between an open position and a closed position along a shaft that passes through the inlet valve. A passageway may be provided in the shaft, the passageway fluidly connecting the pressure vessel with the first opening. Similarly, the outlet valve has an outlet port and is in fluid communication with the second opening of the pressure vessel. The outlet valve may be moveable between a closed position and an open position along a shaft having a passageway that fluidly connects the second opening with the pressure vessel.

When the inlet valve is in its open position, the inlet port is aligned with the first opening leading to the pressure vessel, thereby allowing a volume of pumpable substance to flow through the inlet port and into the pressure vessel. The outlet valve is in its closed position during this operation. The inlet valve is then slid along the shaft to its closed position, thereby sealing the first opening. The outlet valve remains in its closed position, sealing the second opening of the pressure vessel. The pumpable substance within the pressure vessel may then be pressurized by suitable pressurization means to a selected pressure for a selected period of time, depending on the desired result, after which the pumpable substance may be depressurized. The outlet valve is then moved to its open position (the inlet valve remains closed), thereby aligning an outlet port with the second opening of the pressure vessel and allowing the pressure-processed product to be discharged.

In an alternate embodiment, at least one valve may include at least one cleansing chamber coupled to a source of cleansing solution. The cleansing chamber is positioned so that the cleansing solution is applied to a surface that faces the valve. The surface may be located near an opening of the pressure vessel, or may be near the end of the valve. As the valve is repeatedly cycled through its range of positions, the cleansing solution is continuously or periodically flowed within the cleansing chamber and over the surface, thereby cleansing the surface and reducing the potential for contamination therefrom.

Alternately, the apparatus may include at least one nozzle coupled to a source of cleansing solution. The nozzle may continuously or periodically direct a flow of cleansing solution onto the surface, thereby cleansing the surface and reducing the potential for contamination therefrom.

DETAILED DESCRIPTION OF THE INVENTION

The present invention is directed toward methods and apparatus for pressure-processing of pumpable substances, such as food products. Many specific details of certain embodiments of the invention are set forth in the following description, and in FIGS. 1 through 10, to provide a thorough understanding of such embodiments. One skilled in the art, however, will understand that the present invention may have additional embodiments, and that they may be practiced without several of the details described in the following description.

One embodiment of a pressure-processing apparatus in accordance with the invention includes an inlet valve, an outlet valve, and a pressure vessel assembly. During a "fill" step, the inlet valve is opened, the outlet valve is closed, and a pumpable substance is loaded into the pressure vessel assembly through the inlet valve. During a "pressurization" step, the inlet valve is closed, the outlet valve remains closed, and the pumpable substance in the pressure vessel assembly is pressurized using any type of means for pressurization. Finally, during a "discharge" step, the inlet valve remains closed, the outlet valve is opened, and the pressure-processed product is discharged through the outlet valve. The steps may then be repeated. Thus, in this embodiment, the flow of the pumpable substance is controlled by the inlet valve, and the flow of the pressure-processed product is controlled by the outlet valve.

Figure 1:
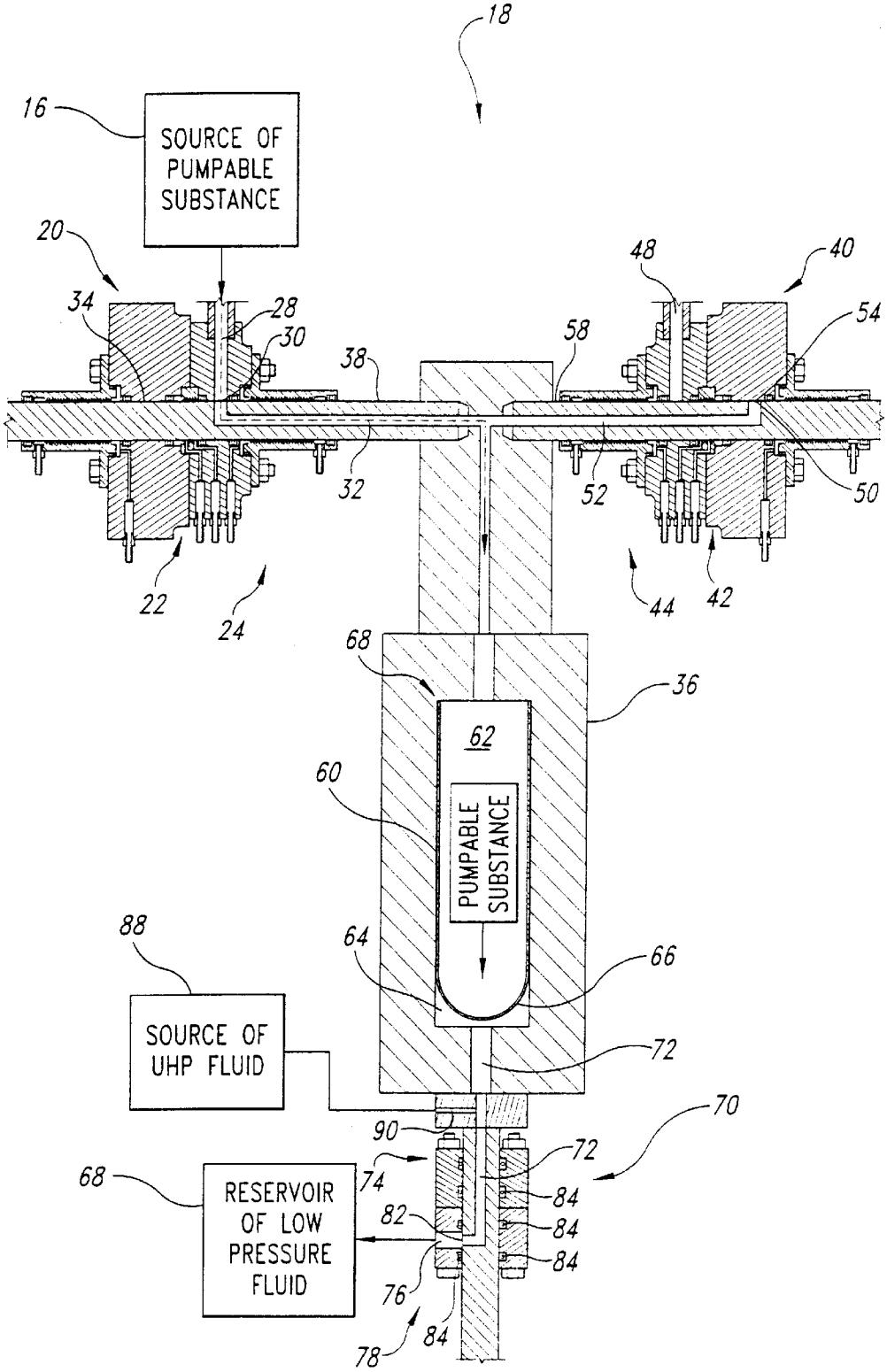
FIG. 1 is a cross-sectional view of a pressure-processing apparatus having two valves, shown in a "fill" position, in accordance with an embodiment of the present invention.

FIG. 1 shows a cross-sectional view of a pressure-processing apparatus 18 having two valves in accordance with an embodiment of the invention. The pressure-processing apparatus 18 includes an inlet valve assembly 20, an outlet valve assembly 40, and a pressure vessel assembly 36. The apparatus 18 may further include a pressurization means 70. The inlet valve assembly 20 is fluidly coupled to a source of a pumpable substance 16, and to an inlet passageway 32 of the pressure vessel assembly 36. Similarly, the outlet valve assembly 40 is fluidly coupled to an outlet passageway 52 of the pressure vessel assembly 36. The inlet valve assembly 20 and outlet valve assembly 40 may be moved by any appropriate drive means, such as a motor, screwdrive, hydraulic, or pneumatic system, or the assemblies may be operated manually.

The inlet valve assembly 20 has an inlet valve body 22 with an inlet port 28 and an inlet sealing face 34. When the inlet valve assembly 20 is in an open position 24, as shown in FIG. 1, the inlet port 28 is aligned with a first opening 30 leading to the inlet passageway 32. The inlet passageway 32 is in fluid communication with a chamber 60 of the pressure vessel assembly 36, and is part of the pressure vessel assembly 36. The inlet valve assembly 20 may slideable move along an inlet shaft 38, with the inlet passageway 32 being provided in the inlet shaft 38.

Similarly, the outlet valve assembly 40 has an outlet valve body 42 with an outlet port 48 and an outlet sealing face 54. When the outlet valve assembly 40 is in a closed position 44, the outlet sealing face 54 is aligned with a second opening 50 leading to the outlet passageway 52. The outlet passageway 52 is in fluid communication with the chamber 60, and is part of the pressure vessel assembly 36. In the embodiment depicted on FIG. 1, the outlet valve assembly 40 slideably moves on an outlet shaft 58 with the outlet passageway 52 being provided in the outlet shaft 58.

Thus, when the inlet valve assembly 20 is in its open position 24, pumpable substance 16 may flow through the inlet port 28, the first opening 30, and the inlet passageway 32 into the chamber 60. Similarly, when the outlet valve assembly 40 is in its closed position 44, the second opening 50 is sealed by the outlet sealing face 54. In this way, the chamber 60 of the pressure vessel assembly 36 may be filled with pumpable substance 16.

It should be noted that although the embodiment shown on FIG. 1 depicts the first opening 30 leading to the inlet passageway 32, and the second opening 50 leading to the outlet passageway 52, it is possible to locate the first opening 30 and the second opening 50 directly in the wall of the chamber 60. In this way, the inlet passageway 32 and the outlet passageway 52 may be eliminated.

The pressure-processing apparatus 18 may include a pressurization means 70 to pressurize the pumpable substance. Such pressurization means 70 are disclosed in U.S. patent application Ser. No. 08/589,261, which is incorporated herein it its entirety by reference, and are represented by such existing commercially available embodiments as model numbers 25XQ-100, and 7X-80, by Flow International of Kent, Wash.

For example, as shown in FIG. 1, the pressurization means 70 may include a bladder 66, a source of ultrahigh-pressure (UHP) fluid 88, a low-pressure valve assembly 74, and a reservoir of low-pressure fluid 68. The bladder 66 divides the chamber 60 into a first region 62 and a second region 64. The bladder 66 may be fixed at a first end 68 of the chamber 60 and free to expand and contract longitudinally along the length of the chamber 60.

The low-pressure valve assembly 74 is coupled to the second region 64 of the chamber 60. The low-pressure valve assembly 74 has a low-pressure port 76 and a low-pressure sealing face 86. Seals 84 are disposed on either side of the sealing face 86. When the low-pressure valve assembly 74 is in a first position 78, as shown in FIG. 1, the low-pressure port 76 is aligned with a low-pressure opening 82 that leads to secondary passageway 72 that is coupled to the second region 64. The source of ultrahigh-pressure fluid 88 is coupled to the second region 64 via an ultrahigh-pressure port 90 and the secondary passageway 72.

During the "fill" step of the operation, as a pumpable substance 16 enters the first region 62, it acts against the bladder 66 causing it to expand along the length of the chamber 60 to accommodate and encapture the pumpable substance 16. In turn, the bladder 66 forces a low pressure fluid 68 out of the second region 64 through the low-pressure opening 82 and low-pressure port 76, and into the reservoir of low-pressure fluid 68.

Figure 2:
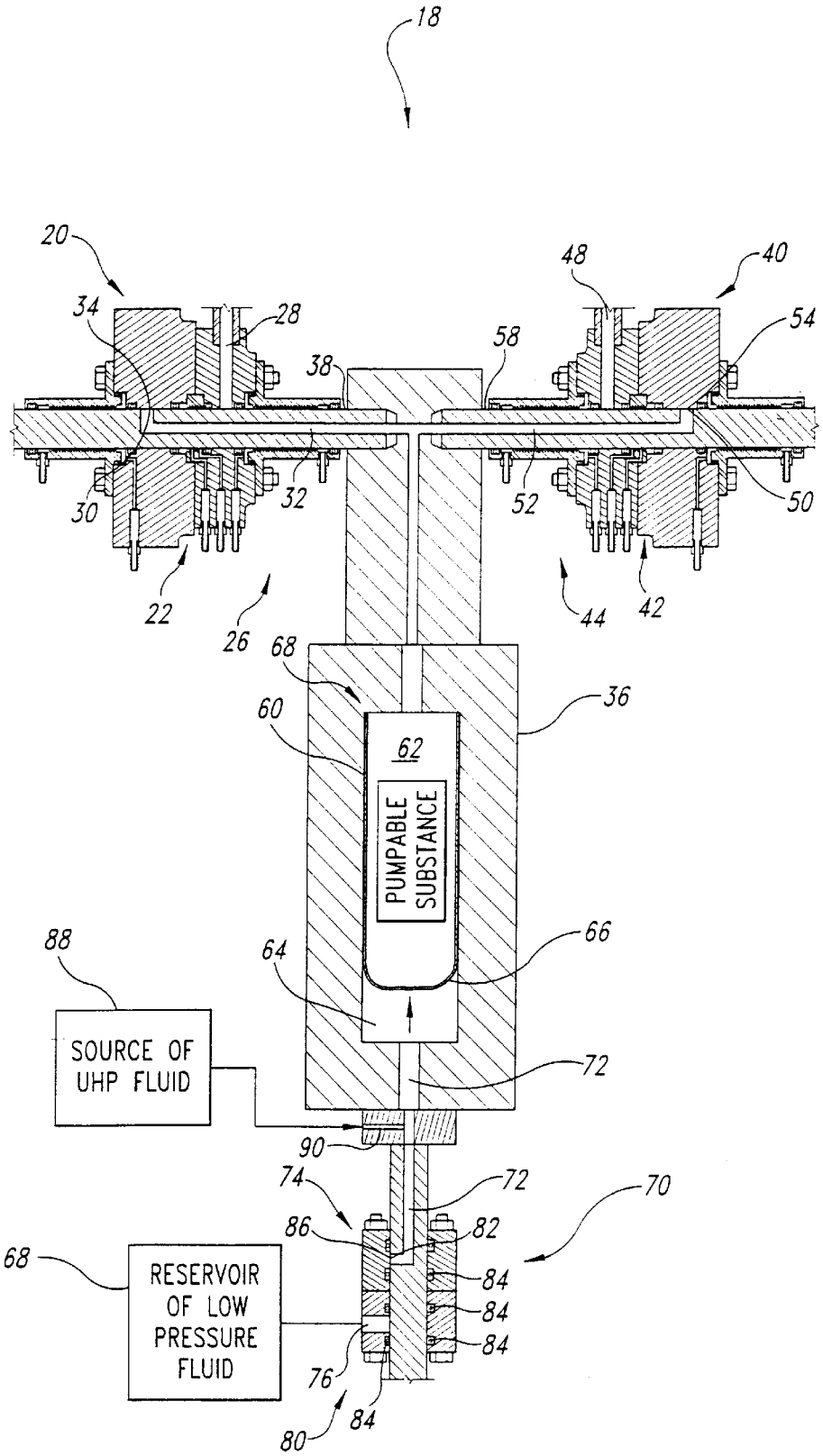
FIG. 2 is a cross-sectional view of the apparatus of FIG. 1, with the valves in a "pressurization" position.

FIG. 2 shows a cross-sectional view of the pressure-processing apparatus 18 of FIG. 1, with the valve assemblies in their respective "pressurization" positions. In this position, the inlet valve assembly 20 is in a closed position 26, and the sealing face 34 seals the first opening 30. Similarly, the outlet valve assembly 40 remains in its closed position 44, and the outlet sealing face 54 seals the second opening 50. The low-pressure valve assembly 74 is moved to a second position 80 so that the low-pressure sealing face 86 seals the low-pressure opening 82.

During the "pressurization" step of the operation, ultrahigh-pressure fluid 88 is released into the second region 64 to act against bladder 66, thereby compressing and pressurizing the pumpable substance 16 to a selected pressure, for a selected period of time. It should be noted that those portions of the pressure-processing apparatus 18 that contain the pressurized pumpable substance during the "pressurization" step include the first region 62, the inlet passageway 32, and the outlet passageway 52. Thus, the inlet shaft 38 and the outlet shaft 58 are part of the pressure vessel assembly 36, and must be built to withstand the same high pressures as the pressure vessel assembly 36. Following pressurization, the pumpable substance 16 may be de-pressurized by, for example, decoupling the source of ultrahigh-pressure fluid 88 from the second region 64 and allowing a quantity of ultrahigh-pressure fluid 88 to flow out of the second region 64.

Figure 3:
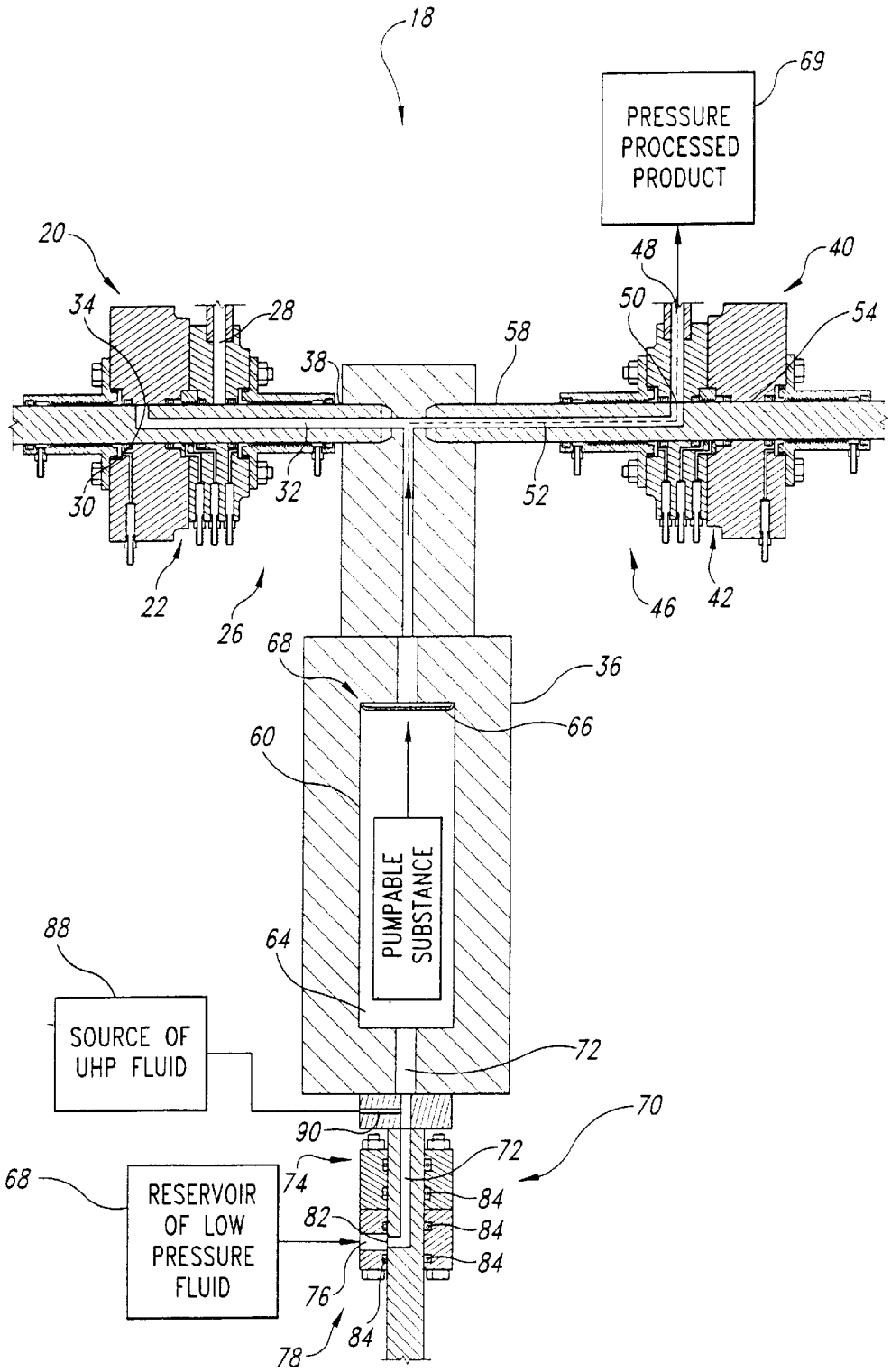
FIG. 3 is a cross-sectional view of the apparatus of FIG. 1, with the valves in a "discharge" position.

FIG. 3 is a cross-sectional view of the apparatus of FIG. 1 with the valve assemblies in their respective "discharge" positions. The inlet valve assembly 20 remains in its closed position 26, and the outlet valve assembly 40 is moved to a an open position 46. Similarly, the low-pressure valve assembly 74 is moved back to its first position 78, aligning the low-pressure port 76 with the low-pressure opening 82.

During the "discharge" step of the operation, low-pressure fluid 68 is forced into the second region 64 via the low-pressure port 76 and secondary passageway 72. The low-pressure fluid 68 acts against the bladder 66, causing it to expand along the length of the chamber 60 to accommodate and encapture the low-pressure fluid 68. In turn, the bladder 66 forces a pressure-processed product 69 out of the first region 62 through the outlet passageway 52, the second opening 50, and the outlet port 48.

One advantage of the above-described embodiment is that the pressure-processed product 69 is not discharged from the pressure vessel assembly 36 back through the same port and valve assembly as the pumpable substance 16 entered through. Thus, by having separate inlet valve assembly 20 for controlling the flow of the pumpable substance 16 and a separate outlet valve assembly 40 for controlling the flow of the pressure-processed product 69, the potential for contamination of the pressure-processed product 69 with the unprocessed pumpable substance 16 and is reduced.

Another embodiment of a pressure-processing apparatus in accordance with the invention includes a valve assembly having a recessed surface proximate a potentially contaminated surface, forming at least one chamber therebetween. The chamber is fluidly coupled to a source of cleansing solution. As the cleansing solution is flowed through the chamber, the potentially contaminated surface is cleansed. The surface may potentially be contaminated by exposure to the outside environment, or by exposure to unprocessed pumpable substance. Thus, through the use of a cleansing chamber, the potential for contamination of the pressure-processed product may be reduced.

Figure 4:
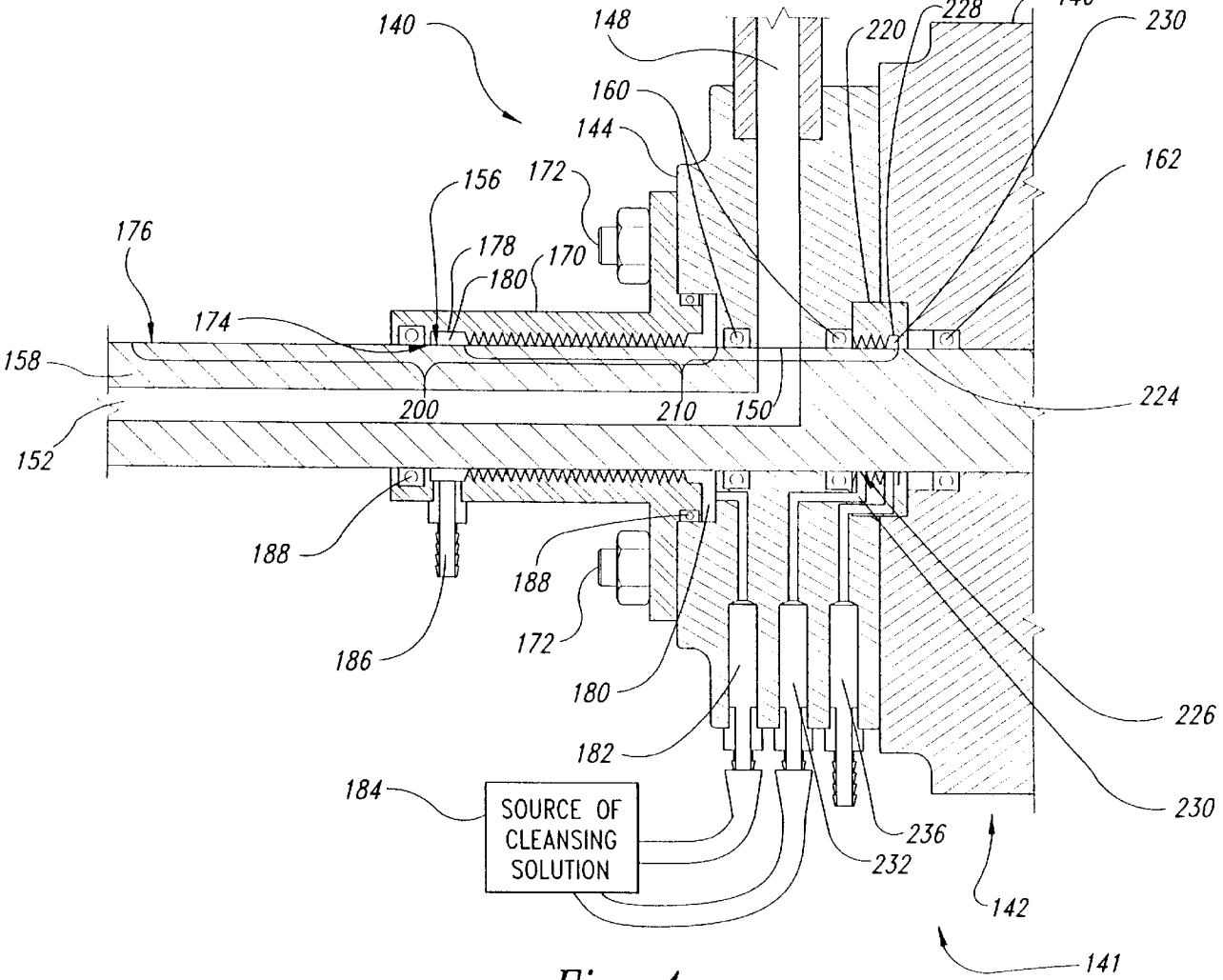
FIG. 4 is an enlarged partial cross-sectional view of an aseptic valve in accordance with an embodiment of the invention.

FIG. 4 is an enlarged partial cross-sectional view of an aseptic outlet valve assembly 140 in accordance with an embodiment of the invention. The aseptic outlet valve assembly 140 includes an aseptic outlet valve body 142 having a first segment 144, a second segment 146, a third segment 170, and a fourth segment 220. Generally speaking, the first segment 144 has elements that are used during the "discharge" step, the second segment 146 has elements that are used during the "pressurization" step, the third segment 170 has elements that cooperate to cleanse a first potentially-contaminated surface, and the fourth segment 220 has elements that cooperate to cleanse a second potentially-contaminated surface.

The first segment 144 has an outlet port 148 that is aligned with a discharge outlet 150 of an outlet passageway 152 when the aseptic outlet valve body 142 is in its open position 141, as shown in FIG. 4. Low-pressure seals 160 are disposed within the first segment 144 on opposite sides of the outlet port 148. The second segment 146 has a sealing face 154 which is aligned with the discharge outlet 150 when the aseptic outlet valve body 142 is in its closed position. High-pressure seals 162 (one shown in FIG. 4) are disposed within the second segment 146 on opposite sides of the sealing face 154. The aseptic outlet valve body 142 may be slideably movable along an outlet shaft 158, the outlet passageway 152 and discharge outlet 150 being disposed within the outlet shaft 158.

The third segment 170 may be attached to the first segment 144 with bolts 172. The third segment 170 has a first inner surface 174 which faces a first outer surface 176 of the outlet shaft 158. The first outer surface 176 is alternately exposed to the outside environment as the aseptic outlet valve assembly 140 cycles between its open and closed positions. The first inner surface 174 has a first continuous recess 178, forming a first cleansing chamber 180 between the first inner surface 174 and the first outer surface 176. A variety of configurations of the first continuous recess 178 are possible, including single or multiple pockets, one or more annular rings, and multiple branch configurations. Alternately, the first continuous recess 178 may be disposed within the first outer surface 176 of the outlet shaft 158, thus forming the first cleansing chamber 180 therebetween.

In the embodiment shown in FIG. 4, the first segment 144 has a first solution inlet 182 passing therethrough, the first solution inlet 182 being fluidly coupled to a source of cleansing solution 184 and to the first cleansing chamber 180. Similarly, the third segment 170 has a first solution outlet 186, the first solution outlet 186 being fluidly coupled with the first cleansing chamber 180. Seals 188 are provided within the third segment 170 at opposite ends of the first cleansing chamber 180.

Thus, during operation, cleansing solution 184 flows through the first solution inlet 182 and into the first cleansing chamber 180, thereby contacting and cleansing the first outer surface 176. The cleansing solution then flows out of the first cleansing chamber 180 via the first solution outlet 186. As the aseptic outlet valve assembly 140 cycles through its entire range of positions, a first surface zone 200 is cleansed. The cleansing solution 184 may be flowed continuously through the cleansing chamber 180, or may be flowed periodically to clean the potentially contaminated surface at specific points during the pressure-processing cycle.

One advantage of the above-described embodiment is that the first surface zone 200 is cleansed (continuously or periodically) during operation of the pressure-processing apparatus 18, and not merely during periods of maintenance. Because a portion of the first surface zone 200 is alternately exposed to the outside environment as the aseptic outlet valve assembly 140 moves along the shaft, the first surface zone 200 may potentially become contaminated during operation of the pressure-processing apparatus 18. By cleansing this zone (continuously or periodically) during operation of the pressure-processing apparatus 18, the potential for transference of contaminants from the outside environment to the pressure-processed product 69 may be reduced in a simple, efficient, cost-effective manner.

The fourth segment 220, similar to the third segment 170, has a second inner surface 224 which faces a second outer surface 226 of the outlet shaft 158. The second inner surface 224 has a second continuous recess 228, forming a second cleansing chamber 230 between the second inner surface 224 and the second outer surface 226. As with the first continuous recess 178, a variety of second continuous recess 228 configurations are feasible.

To supply cleansing solution 184 to the second cleansing chamber 230, the first segment 144 has a second solution inlet 232, the second solution inlet 232 being fluidly coupled to the source of cleansing solution 184 and to the second cleansing chamber 230. The second cleansing chamber 230 is also fluidly coupled to a second solution outlet 236. In the embodiment shown in FIG. 4, the second solution outlet 236 passes through both the fourth segment 220 and the first segment 144, however, other alternate paths for routing the cleansing solution 184 are possible.

During operation, cleansing solution 184 flows through the second solution inlet 232 and into the second cleansing chamber 230. The cleansing solution 184 traverses the second cleansing chamber 230, thereby contacting and cleansing the second outer surface 226, and then flows out of the second cleansing chamber 230 via the second solution outlet 236. Thus, as the aseptic outlet valve assembly 140 cycles through its entire range of positions, a second surface zone 210 is cleansed.

Because a portion of the second surface zone 210 is alternately exposed to the discharge outlet 150 and the outlet sealing face 154 as the aseptic outlet valve assembly 140 moves along the shaft 158, the second surface zone 210 may potentially become contaminated with the pressure-processed product 69, the unprocessed pumpable substance 16, or both. As with the first surface zone 200, an advantage of the above-described embodiment is that by cleansing the second surface zone 210 (continuously or periodically) during operation of the pressure-processing apparatus 18, the potential for transference of unprocessed pumpable substance 16 from the second surface zone 210 to the pressure-processed product 69 is reduced.

It should be noted that although the embodiment shown in FIG. 4 has been described in terms pertaining to an outlet valve, the elements which cooperate to cleanse the first surface zone 200 and second surface zone 210 arc equally applicable to an inlet valve. Also, it should be noted that the respective cleansing solution inlets and outlets leading to the first and second cleansing chambers have been described with reference to the particular embodiment shown. Alternate embodiments having different cleansing solution inlet and outlet paths are possible, or alternately, the flow of cleansing solution through the cleansing chambers may be reversed from that described above.

Figure 5:
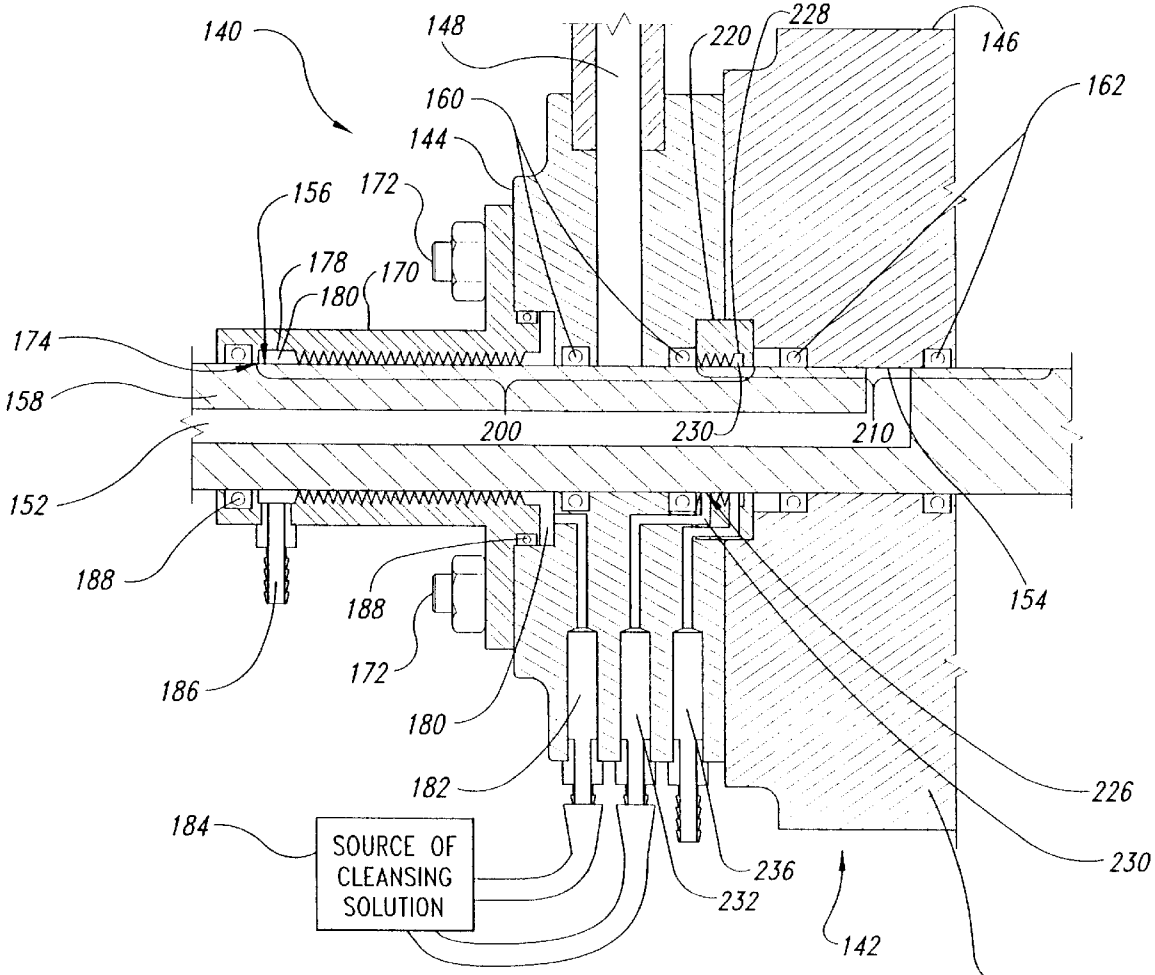
FIG. 5 is an enlarged partial cross-sectional view of the aseptic valve embodiment of FIG. 4, shown in the closed position.

FIG. 5 is an enlarged cross-sectional view of the aseptic valve embodiment of FIG. 4, shown in the closed position 143. In this position, the outlet sealing face 154 is aligned with the discharge outlet 150. For a two-position valve, the valve's open position 141 and closed position 143 define the limits of travel of the aseptic outlet valve assembly 140, and therefore define the extent of the first surface zone 200 and second surface zone 210 which are cleansed by their respective cooperating elements.

Figure 6:
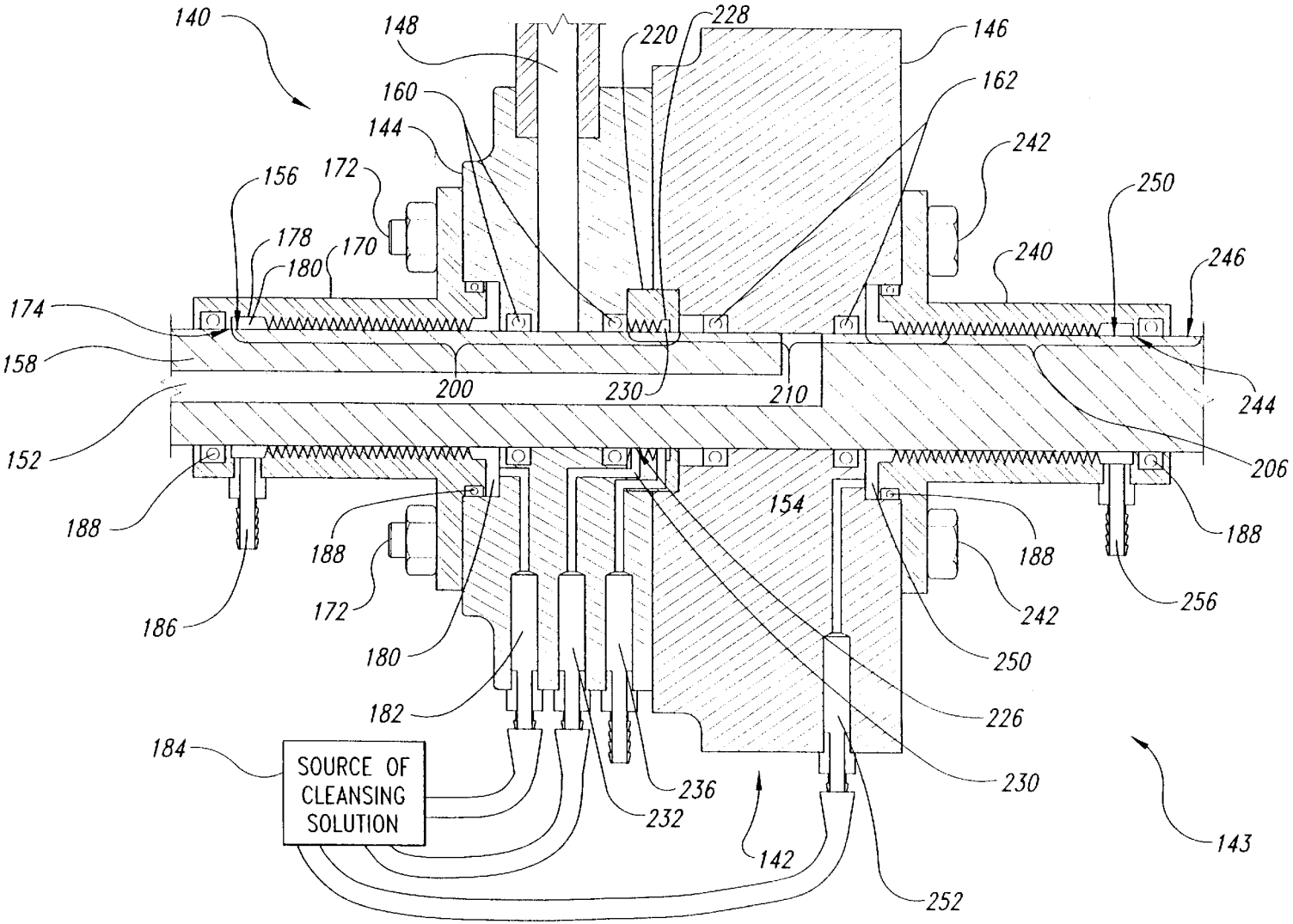
FIG. 6 is an enlarged cross-sectional view of an aseptic valve in accordance with another embodiment of the invention, shown in the closed position.

Another embodiment of an aseptic valve assembly in accordance with the invention includes an additional cleansing chamber for cleansing a surface that may potentially be contaminated by exposure to the outside environment. FIG. 6 is an enlarged cross-sectional view of an aseptic outlet valve assembly 140 shown in the closed position 143. In addition to the elements described above, the aseptic outlet valve body 142 has a fifth segment 240 that is attached to the second segment 146 using bolts 242. In a manner similar to the cooperating elements of the third segment 170 and the fourth segment 220 described above, the fifth segment 240 has a third inner surface 244 which faces a third outer surface 246 of the outlet shaft 158. The third inner surface 244 has a third continuous recess 248 disposed therein, forming a third cleansing chamber 250 between the inner surface 244 and the third outer surface 246.

To supply cleansing solution 184 to the third cleansing chamber 250, third solution inlet 252 is provided within the second segment 146. The third solution inlet 252 is fluidly coupled to the source of cleansing solution 184 and to the third cleansing chamber 250. A third solution outlet 256 is fluidly coupled with the third cleansing chamber 250, and seals 188 are provided to prevent cleansing solution 184 from leaking from the third cleansing chamber 250.

Thus, in the same manner as described above for the first surface zone 200, a third surface zone 206 is continuously or periodically cleansed during operation of the pressure processing apparatus 18. Because a portion of the third surface zone 206 is alternately exposed to the outside environment as the aseptic outlet valve assembly 140 moves along the shaft 158, the third surface zone 206 may potentially become contaminated. By cleansing this zone (continuously or periodically) during operation of the pressure-processing apparatus 18, the potential for transference of contaminants from the outside environment to the pressure-processed product 69 is reduced.

In an alternate embodiment in accordance with the invention, the pressure-processing apparatus further includes at least one nozzle that is fluidly coupled to a source of cleansing solution. The nozzle is positioned near a potentially contaminated surface and is used to direct cleansing solution onto the potentially contaminated surface. Thus, the surface is cleansed and the potential for contamination of the pressure-processed product is reduced.

Figure 7:
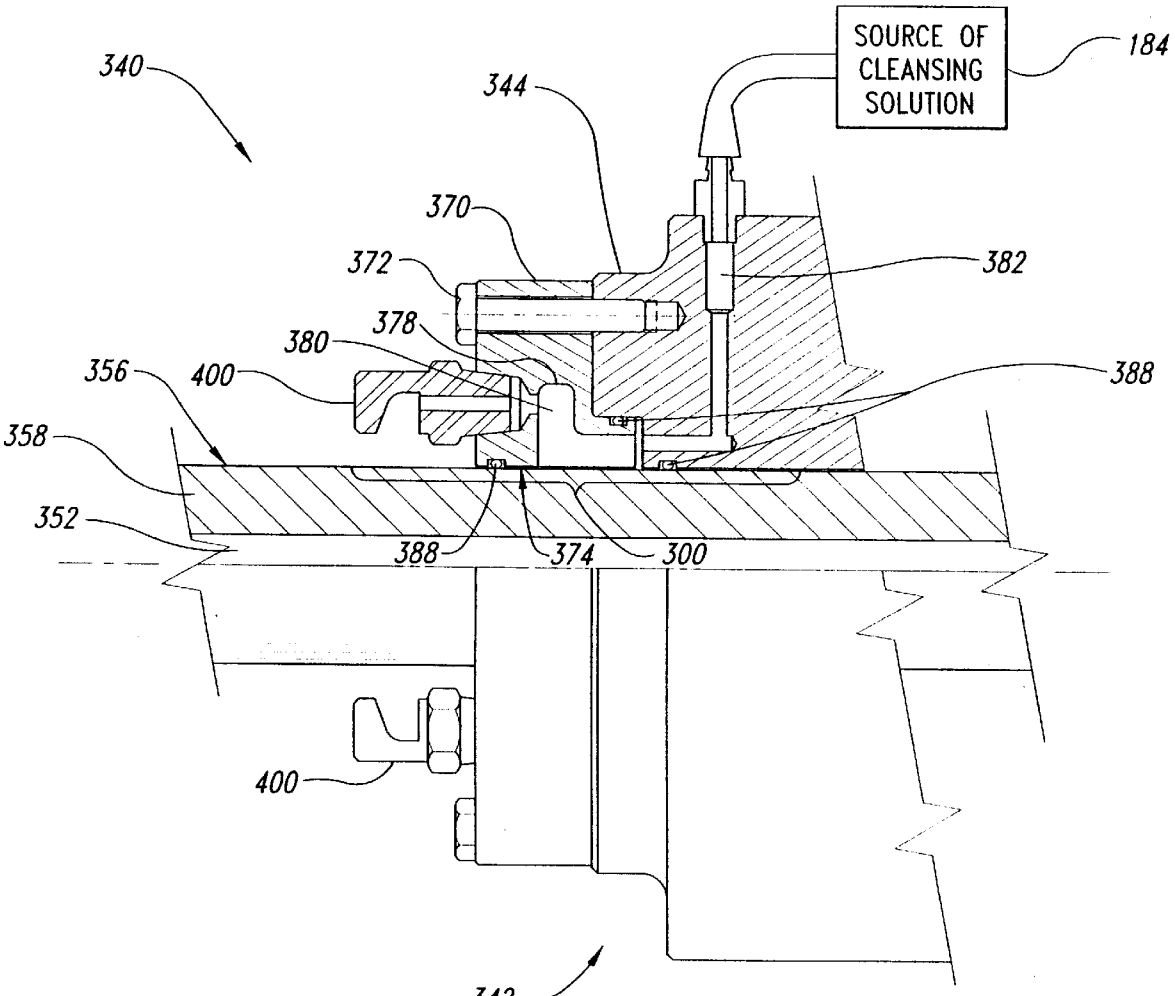
FIG. 7 is an enlarged partial cross-sectional view of an aseptic valve having nozzles in accordance with an embodiment of the invention.

FIG. 7 is an enlarged partial cross-sectional view of an aseptic valve assembly 340 having nozzles 400 in accordance with an embodiment of the invention. In this embodiment, the aseptic valve assembly 340 includes an aseptic valve body 342 having a first segment 344 and an end segment 370. The end segment 370 may be attached to the first segment 344 using bolts 372. The aseptic valve body 342 may be slideably movable along a shaft 358 having a passageway 352 therein. The end segment 370 has a first inner surface 374 facing a first outer surface 356 of the shaft 358. The first inner surface 374 has at least one recess 378, forming a supply chamber 380 between the first inner surface 374 and the first outer surface 356. Seals 388 are provided at the ends of the supply chamber 380 to prevent leakage of the cleansing solution 184.

One or more nozzles 400 may be mounted on the end segment 370. The nozzles 400 are fluidly coupled to the supply chamber 380. A solution inlet 382 is provided in the first segment 344, and is fluidly coupled to a source of cleansing solution 184 and to the supply chamber 380. The nozzles 400 are positioned so as to direct cleansing solution 184 onto the first outer surface 356 of the shaft 358. As the aseptic valve body 342 cycles through its positions, and first surface zone 300 of the shaft 358 is cleansed.

During operation, cleansing solution 184 flows through the solution inlet 382, into the supply chamber 380, and out the nozzle 400 onto the first outer surface 356. The cleansing solution 184 may be flowed out the nozzle 400 continuously or periodically. It should be noted the embodiment of the aseptic valve assembly 340 having nozzles 400 is applicable to both inlet valves and outlet valves of the two-valve pressure-processing apparatus 18, described above and shown in FIG. 1. It should further be noted that the supply chamber 380 may serve the dual function of supplying cleansing solution to the nozzles 400, and may serve as a cleansing chamber in the manner described above.

As with the cleansing chambers described above, an advantage of the embodiment having nozzles 400 is that the surface zones may be cleansed (continuously or periodically) during operation of the pressure-processing apparatus 18, and not merely during periods of maintenance. Also, in certain applications, the directed stream of cleansing solution 184 from the nozzles 400 may provide improved cleansing of the surface zone 300 over the embodiment having a cleansing chamber described above. Thus, the potential for contamination of the pressure-processed product 69 from the outside environment may be reduced in a simple, efficient, cost-effective manner.

In another alternate embodiment, a pressure-processing apparatus in accordance with the invention includes a pressure vessel and a single, three-position valve, where the valve has elements which cooperate to cleanse at least one potentially-contaminated surface during operation. The valve may be positioned in a first or "fill" position, a second or "pressurization" position, and a third or "discharge" position. During the "fill" step, pumpable substance flows through the valve and into the pressure vessel. During the "pressurization" step, the valve is moved to a pressurization position and the pumpable substance is pressurized. Then, during the "discharge" step, the valve is moved to its "discharge" position, and the pressure-processed product is discharged from the pressure vessel through the valve. During each of the three steps of the operation, the cooperating cleansing elements cleanse at least one potentially contaminated surface, thereby reducing the potential for contamination of the pressure-processed product.

Figure 8:
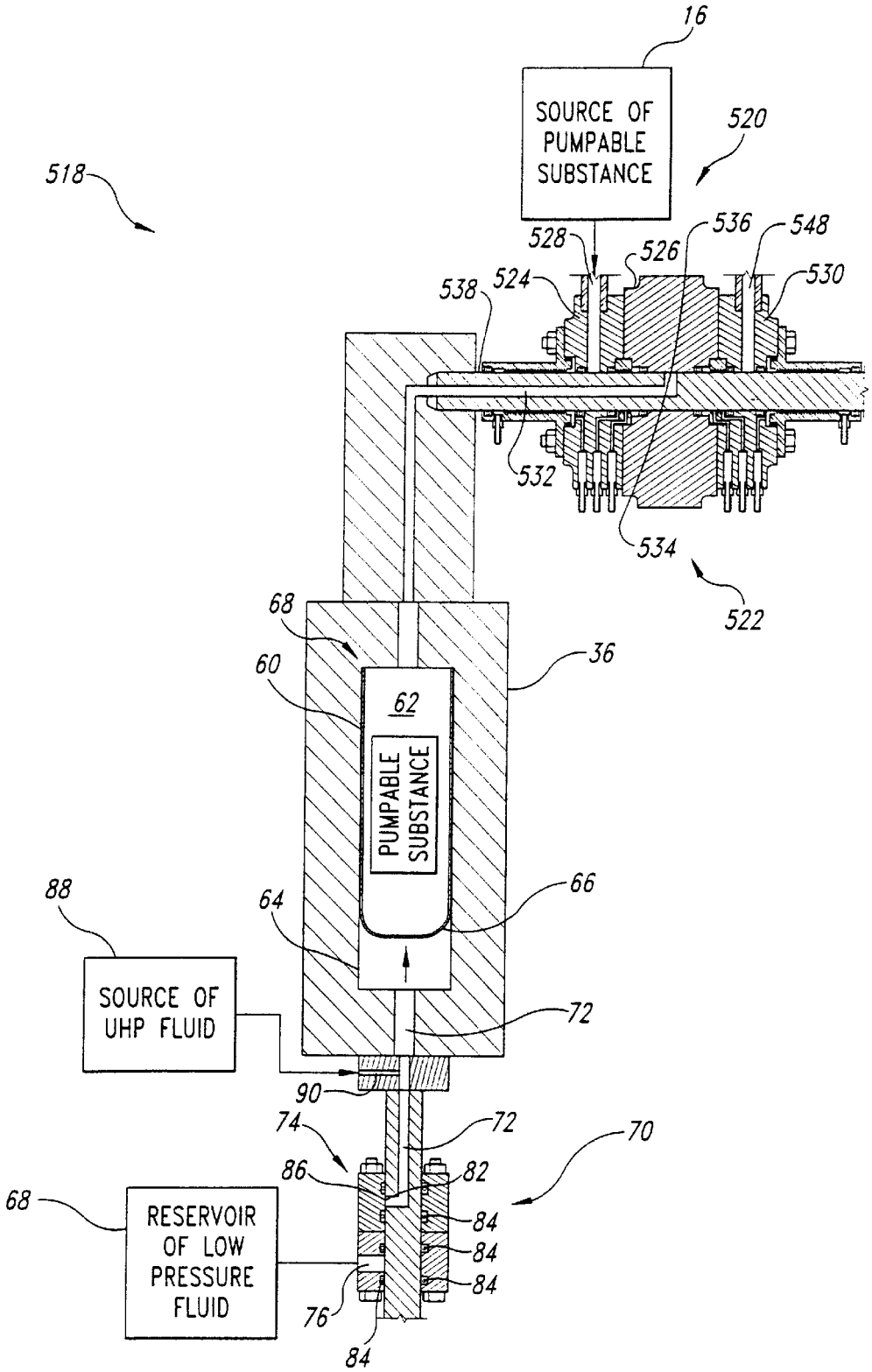
FIG. 8 is a cross-sectional view of a pressure-processing apparatus having a three-position aseptic valve in accordance with an embodiment of the invention.

FIG. 8 shows a cross-sectional view of a pressure-processing apparatus 518 having a three-position aseptic valve assembly 520, and a pressure vessel assembly 36. The apparatus 518 may also include a pressurization means 70. The three-position aseptic valve assembly 520 includes a three-position valve body 522 having a first segment 524, a second segment 526, and a third segment 530. The first segment 524 has an inlet port 528 that is coupled to a source of pumpable substance 16. The second segment 526 has a sealing face 536, and the third segment 530 has an outlet port 548.

In a manner similar to that described above for the inlet valve assembly 20 and the outlet valve assembly 40, the three-position valve body 522 is slideably moveable along a shaft 538 to three positions. In the "fill" position, the inlet port 528 is aligned with an opening 534 in a passageway 532 of the pressure vessel assembly 36, allowing the pressure vessel assembly 36 to be filled with the pumpable substance 16. In the "pressurization" position, the sealing face 536 is aligned with the opening 534, allowing the pressure vessel assembly 36 to be pressurized. In the "discharge" position, the outlet port 548 is aligned with the opening 534, allowing the pressure-processed product 69 to flow out of the pressure vessel assembly 36 through the passageway 532 and the outlet port 548.

Figure 9:
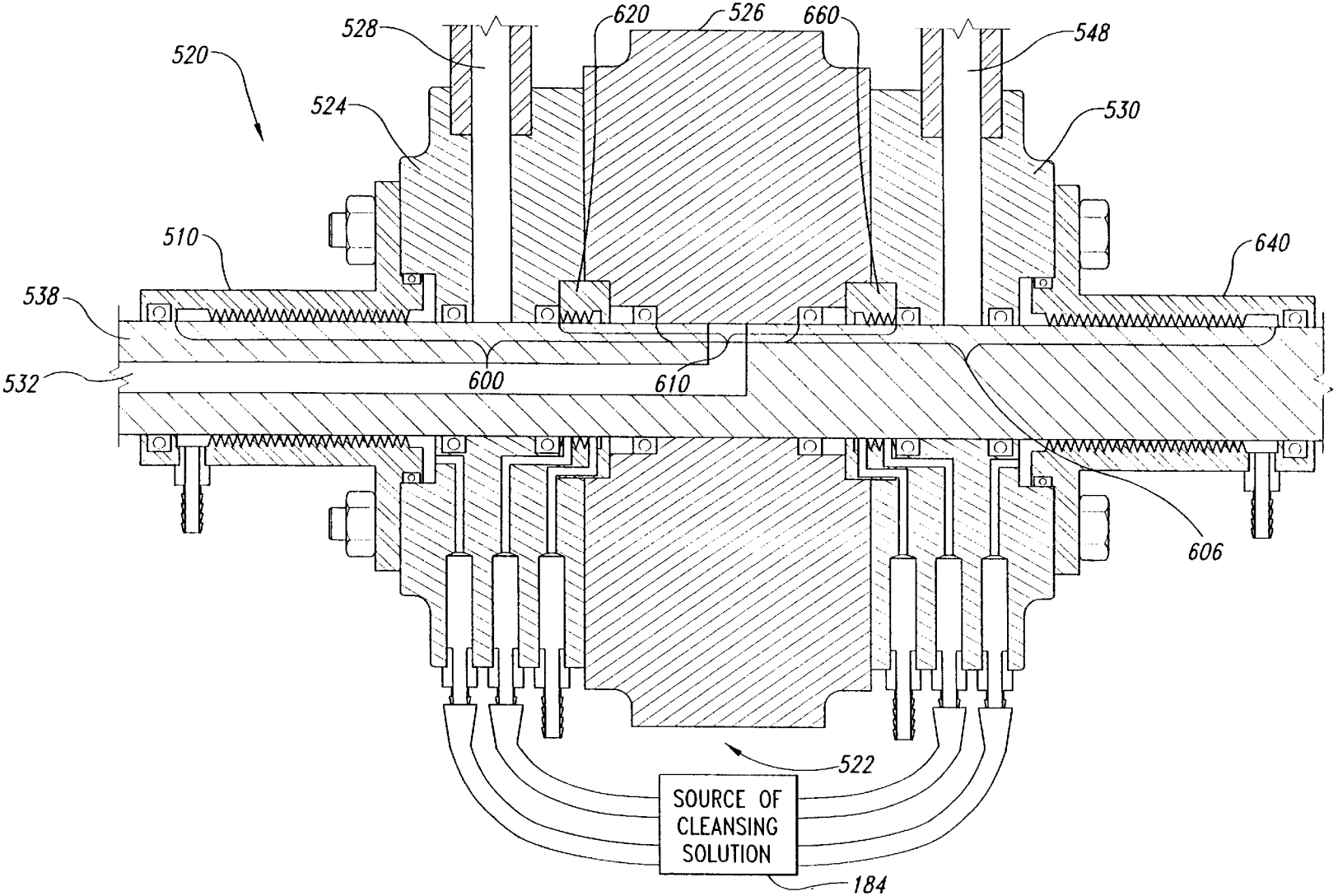
FIG. 9 is an enlarged partial cross-sectional view of the valve shown in FIG. 8 in the second position.

FIG. 9 shows an enlarged partial cross-sectional view of the three-position aseptic valve assembly 520 of FIG. 8. In this view, it is apparent that the three-position valve body 522 has a fourth segment 570, a fifth segment 620, a sixth segment 640, and a seventh segment 660. Generally speaking, the fourth segment 570, fifth segment 620, sixth segment 640, and seventh segment 660 have elements which cooperate to cleanse corresponding surface zones of the shaft 538. In a manner analogous to the embodiments shown in FIGS. 4–6, the cleansing elements associated with the fourth segment 570 cooperate to cleanse fourth surface zone 600, the cleansing elements associated with the fifth segment 620 and the sixth segment 640 cooperate to cleanse a fifth surface zone 610, and the cleansing elements associated with the seventh segment 660 cooperate to cleanse a sixth surface zone 606.

An advantage of the embodiment shown in FIGS. 8–9 is that the potentially contaminated surface zones of the shaft 538 may be cleansed in an apparatus having a single, three-position valve. The potential for contamination is thereby reduced in an apparatus having a single valve that is generally less expensive and easier to maintain than an apparatus having separate inlet and outlet valves.

In yet another alternate embodiment, a pressure-processing apparatus in accordance with the invention may have a single, three-position valve, a pressure vessel, and at least one nozzle for cleansing a potentially contaminated surface zone. The three-position valve is operated in the manner described above to fill the pressure vessel, pressurize the pumpable substance within the pressure vessel, and discharge the pressure-processed product from the pressure vessel. The nozzle is positioned so as to direct cleansing solution onto a potentially contaminated surface, thereby cleansing the surface and reducing the potential for contamination of the pressure-processed product, in the same manner as described above, and as shown on FIG. 7.

Improved methods and apparatus for pressure-processing a pumpable substance have been shown and described. From the foregoing, it will be appreciated that although embodiments of the invention have been described herein for purposes of illustration, various modifications may be made without deviating from the spirit of the invention. Thus, the present invention is not limited to the embodiments described herein, but rather is defined by the claims which follow.

What is claimed is:

1. An apparatus for pressure-processing a pumpable substance, comprising:

a pressure vessel assembly having a passageway coupled thereto, the passageway having a first opening and a second opening;

an inlet valve that is movable between an open position and a closed position, the inlet valve having an inlet port coupled to a source of pumpable substance, the inlet port being in fluid communication the first opening when the inlet valve is in its open position to allow the pumpable substance to flow into the pressure vessel assembly via the inlet port and first opening, the inlet valve sealing the first opening when the inlet valve is in its closed position; and an outlet valve that is movable between an open position and a closed position, the outlet valve sealing the second opening when the outlet valve is in its closed position, the outlet valve having an outlet port in fluid communication with the second opening when the outlet valve is in its open position to allow the pumpable substance to flow out of the pressure vessel via the outlet port and the passageway.

2. The apparatus according to claim 1, further comprising pressurization means for pressurizing the pumpable substance while the pumpable substance is in the pressure vessel assembly.

3. The apparatus according to claim 1 wherein the outlet valve is slideable along a shaft that passes therethrough, the passageway being provided in the shaft.

4. The apparatus according to claim 3 wherein the outlet valve has an inner surface facing an outer surface of the shaft, the inner surface being spaced apart from the outer surface to define at least one chamber therebetween, the chamber being in fluid communication with a source of cleansing solution.

5. The apparatus according to claim 4 wherein the chamber is proximate to the outlet port.

6. The apparatus according to claim 4 wherein the outlet valve includes a sealing face that seals the second opening when the outlet valve is in its closed position, the chamber being proximate to the sealing face.

7. The apparatus according to claim 6, further comprising at least one seal disposed about the sealing face.

8. The apparatus according to claim 1 wherein the inlet valve is slideable along a shaft that passes therethrough, the passageway being provided in the shaft.

9. The apparatus according to claim 8 wherein the inlet valve has an inner surface facing an outer surface of the shaft, the inner surface being spaced apart from the outer surface to define at least one chamber therebetween, the chamber being in fluid communication with a source of cleansing solution.

10. The apparatus according to claim 9 wherein the chamber is proximate to the inlet port.

11. The apparatus according to claim 9 wherein the inlet valve includes a sealing face that seals the first opening when the inlet valve is in its closed position, the chamber being proximate to the sealing face.

12. The apparatus according to claim 11, further comprising at least one seal disposed about the sealing face.

13. The apparatus according to claim 1 wherein the pressure vessel has at least one outer surface, further comprising at least one nozzle in fluid communication with a source of cleansing solution, the nozzle being directed toward the outer surface.

14. The apparatus according to claim 13 wherein the outer surface is proximate to the outlet valve.

15. The apparatus according to claim 14 wherein the outer surface is exposed to the nozzle when the outlet valve is in its open position.

16. The apparatus according to claim 13 wherein the outer surface is proximate to the inlet valve.

17. The apparatus according to claim 16 wherein the outer surface is exposed to the nozzle when the inlet valve is in its open position.

18. The apparatus according to claim 13 wherein the cleansing solution is flowed through the nozzle continuously.

19. An apparatus for pressure-processing a pumpable substance, comprising:

a pressure vessel assembly having a passageway coupled thereto, the passageway having an opening;

a valve that is slideably movable along a shaft that passes therethrough, the passageway being provided in the shaft, the valve being movable between a first position, a second position, and a third position;

the valve having an inlet port coupled to a source of pumpable substance and an outlet port, the inlet port being in fluid communication with the opening when the valve is in the first position to allow the pumpable substance to flow into the pressure vessel assembly, the valve sealing the opening when the valve is in its second position, the outlet port being in fluid communication with the opening when the valve is in the third position to allow the pumpable substance to flow out of the pressure vessel assembly; and the valve further having an inner surface facing an outer surface of the shaft, the inner surface being spaced apart from the outer surface to define at least one chamber therebetween, the chamber being in fluid communication with a source of cleansing solution.

20. The apparatus according to claim 19, further comprising pressurization means for pressurizing the pumpable substance while the pumpable substance is in the pressure vessel assembly.

21. The apparatus according to claim 19 wherein the chamber is proximate to the outlet port.

22. The apparatus according to claim 19 wherein the valve includes a sealing face that seals the opening when the valve is in its second position, the chamber being proximate to the sealing face.

23. The apparatus according to claim 22, further comprising at least one seal disposed about the sealing face.

24. The apparatus according to claim 19 wherein the chamber is proximate to the inlet port.

25. An apparatus for pressure-processing a pumpable substance, comprising:

a pressure vessel assembly having a passageway coupled thereto, the passageway having an opening;

a valve that is slideably movable along a shaft that passes therethrough, the passageway being provided in the shaft, the valve being movable between a first position, a second position, and a third position;

the valve having an inlet port coupled to a source of pumpable substance and an outlet port, the inlet port being in fluid communication with the opening when the valve is in the first position to allow the pumpable substance to flow into the pressure vessel assembly, the valve sealing the opening when the valve is in its second position, the outlet port being in fluid communication with the opening when the valve is in the third position to allow the pumpable substance to flow out of the pressure vessel assembly;

the shaft having at least one outer surface; and at least one nozzle in fluid communication with a source of cleansing solution, the nozzle being directed toward the outer surface.

26. The apparatus according to claim 25 wherein the outer surface is exposed to the nozzle when the valve is in its first position.

27. The apparatus according to claim 25 wherein the outer surface is exposed to the nozzle when the valve is in its third position.

28. The apparatus according to claim 25 wherein the cleansing solution is flowed through the nozzle continuously.

29. An apparatus for pressure-processing a pumpable substance, comprising:

a pressure vessel assembly having a first surface zone and a second surface zone, a first opening being disposed in the first surface zone, and a second opening being disposed in the second surface zone;

an inlet valve proximate the first surface zone, the inlet valve being slideably movable over the first surface zone between an open position and a closed position, the inlet valve having an inlet port coupled to a source of pumpable substance, the inlet port being in fluid communication the first opening when the inlet valve is in its open position to allow the pumpable substance to flow into the pressure vessel assembly via the inlet port and first opening, the inlet valve scaling the first opening when the inlet valve is in its closed position; and an outlet valve proximate the second surface zone, the outlet valve being slideably movable over the second surface zone between a closed position and an open position, the outlet valve sealing the second opening when the outlet valve is in its closed position, the outlet valve having an outlet port in fluid communication with the second opening when the outlet valve is in its open position to allow the pumpable substance to flow out of the pressure vessel via the outlet port and the passageway.

30. The apparatus according to claim 29 wherein the inlet valve has an inner surface facing the first surface zone, the inner surface being spaced apart from the first surface zone to define at least one chamber therebetween, the chamber being in fluid communication with a source of cleansing solution.

31. The apparatus according to claim 29 wherein the outlet valve has an inner surface facing the second surface zone, the inner surface being spaced apart from the second surface zone to define at least one chamber therebetween, the chamber being in fluid communication with a source of cleansing solution.

32. The apparatus according to claim 29, further comprising at least one nozzle in fluid communication with a source of cleansing solution, the nozzle being directed toward the first surface zone.

33. The apparatus according to claim 29, further comprising at least one nozzle in fluid communication with a source of cleansing solution, the nozzle being directed toward the second surface zone.

34. An apparatus for pressure-processing a pumpable substance, comprising:

a pressure vessel assembly having a surface zone and an opening disposed within the surface zone;

a valve that is slideably movable over the surface zone between a first position, a second position, and a third position;

the valve having an inlet port coupled to a source of pumpable substance and an outlet port, the inlet port being in fluid communication with the opening when the valve is in the first position to allow the pumpable substance to flow into the pressure vessel assembly, the valve sealing the opening when the valve is in its second position, the outlet port being in fluid communication with the opening when the valve is in the third position to allow the pumpable substance to flow out of the pressure vessel assembly; and the valve further having an inner surface facing the surface zone, the inner surface being spaced apart from the surface zone to define at least one chamber therebetween, the chamber being in fluid communication with a source of cleansing solution.

35. The apparatus according to claim 34 wherein the chamber is proximate to the outlet port.

36. The apparatus according to claim 34 wherein the valve includes a sealing face that seals the opening when the valve is in its second position, the chamber being proximate to the sealing face.

37. An apparatus for pressure-processing a pumpable substance, comprising:

a pressure vessel assembly having a surface zone and an opening disposed within the surface zone;

a valve that is slideably movable over the surface zone between a first position, a second position, and a third position;

the valve having an inlet port coupled to a source of pumpable substance and an outlet port, the inlet port being in fluid communication with the opening when the valve is in the first position to allow the pumpable substance to flow into the pressure vessel assembly, the valve sealing the opening when the valve is in its second position, the outlet port being in fluid communication with the opening when the valve is in the third position to allow the pumpable substance to flow out of the pressure vessel assembly; and at least one nozzle in fluid communication with a source of cleansing solution, the nozzle being directed toward the surface zone.

38. A method for pressure-processing a pumpable food substance, comprising:

positioning an inlet valve in an open position to fluidly couple a source of pumpable substance with a first opening of a pressure vessel assembly;

positioning an outlet valve in a closed position to seal a second opening of the pressure vessel assembly;

filling the pressure vessel assembly with a pumpable substance;

positioning the inlet valve in a closed position to seal the first opening of the pressure vessel assembly;

pressurizing the pumpable substance within the pressure vessel assembly to form a pressure-processed product;

positioning the outlet valve in an open position to unseal the second opening of the pressure vessel assembly; and discharging the pressure-processed product from the pressure vessel assembly through the second opening.

39. The method according to claim 38, further comprising the step of de-pressurizing the pressure-processed product.

40. The method according to claim 38, further comprising the step of cleansing at least one surface of the pressure vessel assembly with a cleansing solution during operation, the surface having the potential of contaminating the pressure-processed product.

41. The method according to claim 38 wherein the surface is proximate to the outlet valve.

42. The method according to claim 38 wherein the surface is proximate to the inlet valve.

43. The method according to claim 40 wherein the step of cleansing includes flowing a cleansing solution through a chamber proximate the surface and onto the surface.

44. The method according to claim 40 wherein the step of cleansing includes directing a cleansing solution through a nozzle and onto the surface.

45. A method for pressure-processing a pumpable food substance, comprising:

positioning a valve in a first position to fluidly couple a source of pumpable substance with an opening of a pressure vessel assembly;

filling the pressure vessel assembly with a pumpable substance;

positioning the valve in a second position to seal the opening;

pressurizing the pumpable substance within the pressure vessel assembly to form a pressure-processed product;

positioning the valve in a third position to unseal the opening;

discharging the pressure-processed product from the pressure vessel assembly through the opening; and cleansing at least one surface of the pressure vessel assembly with a cleansing solution during operation, the surface having the potential of contaminating the pressure-processed product.

46. The method according to claim 45, further comprising the step of de-pressurizing the pressure-processed product.

47. The method according to claim 45 wherein the step of cleansing includes flowing a cleansing solution through a chamber proximate the surface and onto the surface.

48. The method according to claim 45 wherein the step of cleansing includes directing a cleansing solution through a nozzle and onto the surface.

* * * * *

UNITED STATES PATENT AND TRADEMARK OFFICE

CERTIFICATE OF CORRECTION

PATENT NO : 6,158,981
DATED : December 12, 2000
INVENTOR(S) : Reghavan et al.

It is certified that errors appear in the above-identified patent and that said Letters Patent are hereby corrected as shown below:

Claim 29, column 12, line 49 "inlet valve scaling the" should read --inlet valve sealing the--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,158,981
DATED : December 12, 2000
INVENTOR(S) : Raghavan et al.

It is certified that error appears in the above-identified patent and that said Letters Patent is hereby corrected as shown below:

Column 12, claim 29,
Line 49, "inlet valve scaling the" should read -- inlet valve sealing the --.

This certificate supercedes certificate of correction issued May 22, 2001.

Signed and Sealed this

Sixth Day of November, 2001

*Attest:*

Nicholas P. Godici

NICHOLAS P. GODICI
*Acting Director of the United States Patent and Trademark Office*

*Attesting Officer*